United States Patent [19]

Yoshida

[11] 4,306,338

[45] Dec. 22, 1981

[54] SLIDE FASTENER STRINGER

[75] Inventor: Hiroshi Yoshida, Kurobe, Japan

[73] Assignee: Yoshida Kogyo K.K., Tokyo, Japan

[21] Appl. No.: 122,018

[22] Filed: Feb. 19, 1980

[30] Foreign Application Priority Data

Mar. 26, 1979 [JP] Japan ..... 54-35288

[51] Int. Cl.[3] ..... A44B 19/14

[52] U.S. Cl. ..... 24/205.16 C; 24/205.1 C

[58] Field of Search ..... 24/205.1 C, 205.13 C, 24/205.16 C, 205.16 R

[56] References Cited

U.S. PATENT DOCUMENTS

| | | | |
|---|---|---|---|
| 3,768,125 | 10/1973 | Fröhlich | 24/205.16 C |
| 3,783,476 | 1/1974 | Fröhlich | 24/205.16 C |
| 3,815,181 | 6/1974 | Sekine | 24/205.16 C X |
| 3,854,174 | 12/1974 | Yoshida | 24/205.16 C X |
| 4,034,444 | 7/1977 | Moertel | 24/205.16 C X |
| 4,182,006 | 1/1980 | Yoshida | 24/205.16 C X |
| 4,182,007 | 1/1980 | Yoshida et al. | 24/205.16 C |

*Primary Examiner*—Roy D. Frazier
*Assistant Examiner*—Peter A. Aschenbrenner
*Attorney, Agent, or Firm*—Bucknam and Archer

[57] ABSTRACT

A slide fastener stringer includes a stringer tape and a series of fastener elements sewn to the stringer tape on one of the opposite surfaces thereof along its one longitudinal edge by means of double locked stitches composed of at least one needle thread and a looper thread. The needle thread includes a thermoplastic monofilament yarn, and the looper thread includes a spun or multifilament yarn. The stitching has been done from the tape side of the slide fastener stringer. Loops of the looper thread project hardly from the topmost surface of the needle thread loops so that a slider is not likely to wear it out. Each of the needle thread has a constricted portion which serves to keep the looper thread loops from becoming loose. After stitching of the fastener elements to the tape, the thermoplastic monofilamentary needle thread has been heatset to suitably shrink and then become dimensionally stable.

5 Claims, 16 Drawing Figures

SLIDE FASTENER STRINGER

BACKGROUND OF THE INVENTION

1. Field of the Invention

The present invention relates to a slide fastener stringer including a stringer tape and a series of fastener coupling elements sewn to the tape along one longitudinal edge thereof by utilizing multi-thread chain stitch or "double locked stitch".

2. Prior Art

In sewing a series of fastener coupling elements to a stringer tape for a slide fastener, one of the most widely used stitch types is multi-thread chain stitch or "double locked stitch", which is formed with two or more sewing threads, i.e. needle and looper threads. It has been customary to use a spun or multifilament yarn for either the needle thread or the looper thread, for such non-monofilament yarns are flexible and less stretchable and hence enable the fastener elements to be sewn to the tape tightly on a high-speed sewing machine without breakage of a sewing needle.

A common problem encountered with such prior art slide fastener stringer is that, because the material and fabric structure of modern stringer tapes are usually of the type having less frictional resistance, the sewing threads are liable to become loose from its cut end portions which have been cut as the fastener stringer of a continuous length has been severed into a slide fastener length. With this arrangement, when the opposed stringer tapes are laterally pulled at their one end in opposite directions during threading of a pair of the interengaged fastener stringers through a slider, the extreme one or two or even more of the fastener elements on each tape would be easily displaced. Consequently, it would be difficult or sometimes impossible to mount the slider onto the interengaged fastener stringer.

U.S. Pat. No. 3,783,476 discloses a slide fastener stringer having a row of fastener elements secured to a stringer tape by means of single-needle double locked stitch formed with needle and looper threads, of which only needle thread includes a monofilament yarn. The needle thread is disposed on the fastener-element side of the slide fastener stringer, and hence, the stitching must be done from that side. This requires a specially designed guide means to support the slide fastener stringer such that the surface of the stringer tape on which the fastener elements are to be attached faces upwardly during sewing operation. With this arrangement, sufficient degree of tightness of the stitching is difficult to achieve. Further, because the fastener elements are held, against the stringer tape, by the monofilamentary needle thread and both the fastener elements and the needle thread have less frictional resistance, the needle thread is liable to slip on the fastener elements and hence is not likely to keep the fastener elements stably in position on the tape. Moreover, the looper thread projects from the tape surface so that a slider is likely to wear out the looper thread.

U.S. Pat. No. 3,768,125 discloses another slide fastener stringer having a row of fastener elements secured to a stringer tape by means of single-needle double locked stitch formed with needle and looper threads. Such prior art slide fastener stringer has not sufficient degree of flexibility, which is one of the most important factors for slide fasteners, partly because monofilament yarns have rigidity by nature and partly because loops of the monofilamentary looper thread extend across and over the fastener elements. Further, because the fastener elements are held, against the stringer tape, by the monofilamentary looper thread and both the fastener elements and the monofilamentary looper thread have less frictional resistance, the needle thread is liable to slip on the fastener elements and hence is not likely to keep the fastener elements stably in position on the tape.

SUMMARY OF THE INVENTION

According to the present invention, sewing stitches securing a series of fastener elements to a stringer tape are formed with at least one needle thread and a looper thread. The needle thread consists of a thermoplastic monofilament yarn and has loops each passing through the tape from the underside thereof and extending through a space between adjacent two of the fastener elements. The looper thread consists of a spun or multifilament yarn and has loops extending across and over the fastener elements on the top side of the tape. The needle thread is interlaced and interlooped with the loops of the looper thread, and each of the needle thread loops has a constricted portion engaging with adjacent two of the looper thread loops. After stitching of the fastener elements to the tape, the thermoplastic monofilamentary needle thread has been heat-set to become dimensionally stable. Such constricted portions of the needle thread loops serve to keep the looper thread from becoming loose even at their cut end portions. This prevents the fastener elements from being displaced on the tape at the end of the element row from which a slider is threaded or mounted.

Further, top surfaces of the needle thread loops are disposed above or flush with those of the looper thread loops so that the looper thread can be kept nicely from being worn out due to frictional engagement with a slider.

It is therefore an object of the present invention to provide a slide fastener stringer which enables smooth threading of a slider.

Another object of the invention is to provide a slide fastener stringer which has a row of fastener elements kept stably in position on a stringer tape and hence is free from accidentally splitting apart from a companion stringer when the coupled stringers are bent in either direction.

Still another object of the invention is to provide a slide fastener stringer which can be manufactured less costly.

Many other advantages, features and additional objects of the present invention will become manifest to those versed in the art upon making reference to the detailed description and the accompanying drawings in which preferred structural embodiments incorporating the principles of the present invention are shown by way of example.

DETAILED DESCRIPTION OF THE EMBODIMENTS

Figure 1:
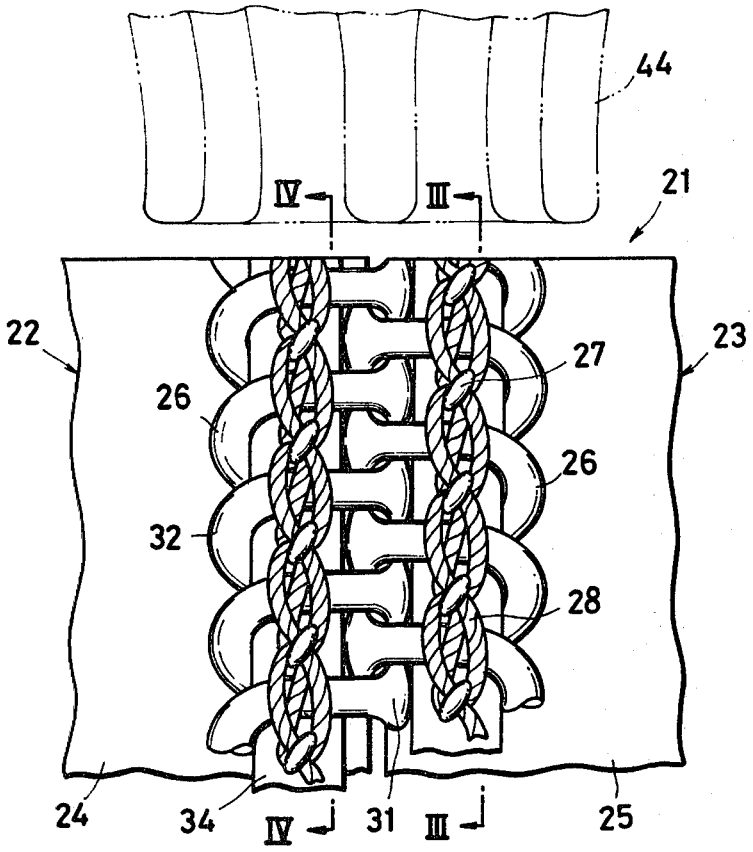
FIG. 1 is a fragmentary top plan view of a pair of interengaged slide fastener stringers each embodying the present invention.
Figure 2:
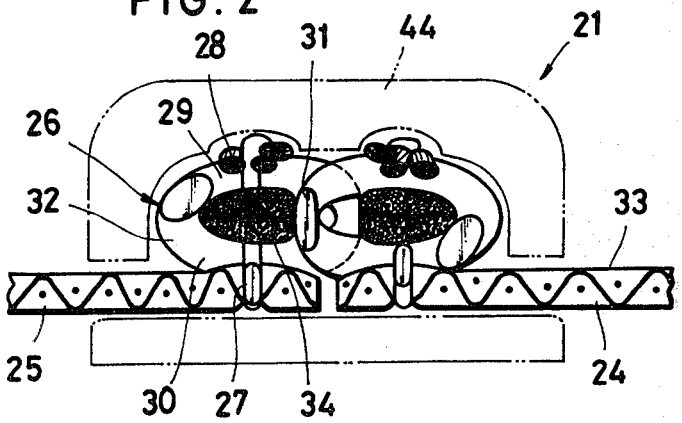
FIG. 2 is an end elevation of the slide fastener stringers of FIG. 1.

The principles of the present invention are particularly useful when embodied in a slide fastener assembly (hereinafter referred to as "slide fastener") such as shown in FIGS. 1–4, generally indicated by the numeral 21.

The slide fastener 21 comprises a pair of fastener stringers 22, 23 including a pair of stringer tapes 24, 25, respectively, each supporting on and along one longitudinal edge thereof a series of fastener elements 26 in the form of a continuous filamentary coil made of a thermoplastic synthetic resin. Each series of fastener elements 26 is secured to one of the tapes 24, 25 by means of sewing stitches. The type of the sewing stitches is multi-thread chain stitch or "double locked stitch", which is formed with a needle thread 27 and a looper thread 28. Each of the fastener elements 26 has a pair of spaced upper and lower legs 29, 30, and a coupling head 31 extending therebetween. The lower leg 30 of each fastener element lies on the top surface 33 (FIGS. 2 and 3) of the stringer tape 24, 25 and is connected to the upper leg 29 of a preceding or succeeding one of the fastener elements 26 by a connecting portion 32, the upper element leg 29 being spaced away from the same tape surface 33. A core 34 in the form of a textile cord extends longitudinally through the series of fastener elements 26 and is held by the needle thread 27 against the connecting portions 32 in the interior of the fastener elements 26.

The needle thread 27 consists of a monofilament yarn made of a thermoplastic synthetic resin such as nylon. The looper thread 28 consists of a non-monofilament yarn, i.e. a multifilament or spun yarn, which is made of a synthetic resin such as polyester.

Figure 3:
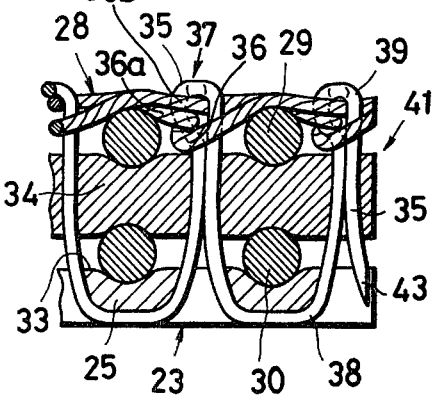
FIG. 3 is a fragmentary cross-sectional view taken along line III—III of FIG. 1.
Figure 4:
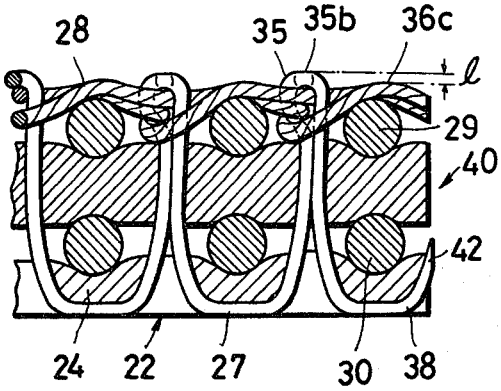
FIG. 4 is a fragmentary cross-sectional view taken along line IV—IV of FIG. 1.
Figure 5:
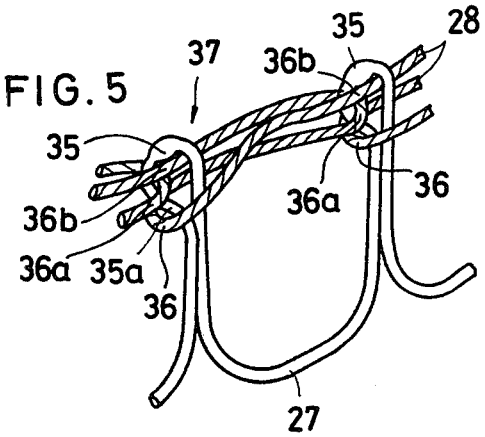
FIG. 5 is a fragmentary perspective view of sewing stitches of FIGS. 1–4, showing the formation of needle and looper threads.
Figure 6:
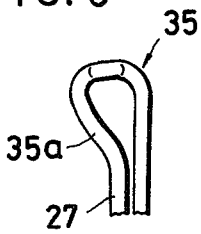
FIG. 6 is a side elevational view of a loop of the needle thread.

As shown in FIG. 3, the needle thread 27 has loops 35 each passing through the tape 24, 25 from the underside thereof and extending through a space between adjacent two of the fastener elements 26, each of the needle thread loops 35 having a constricted portion 35*a* (FIGS. 5 and 6). The loops 35 of the needle thread 27 are interlaced and interlooped with the looper thread 28 such that those interlacings and interloopings 37 are located between adjacent element legs 29. One (36) of adjacent two loops 36, 36*b* of the looper thread 28 extends across and over the upper element leg 29 adjacent thereto and around the constricted portion 35*a* of the needle thread loop 35. The other looper thread loop 36*a* is interlaced with that needle thread loop 35 so as to be disposed above said one looper thread loop 36. One end of the loop 36 is blended into one end of a preceding loop 36*a* through a connecting portion 36*b*, and the other end of the loop 36 is blended into the other end of a succeeding loop 36*a* through a connecting portion 36*b*. The connecting portion 36*b* extends through the corresponding one of the needle thread loops 35 so as to be disposed therein in intimate contact with the looper thread loop 36*a*. As shown in FIGS. 3 and 4, the looper thread loop 36, which extends around the constricted portion 35*a*, is interposed between the looper thread loop 36*a* and the core 34. Thus, the constricted portion 35*a* serves to keep the looper thread loop 36 from becoming loose. The looper thread loop 36*a* and the connecting portion 36*b* extend so as to be disposed closely in the needle thread loop 35 so that the loop 36*a* also is not likely to become loose. Further, the individual needle thread loops 35 extend upwardly beyond the topmost surfaces 36*a* (FIG. 4) of the looper thread 28 by a predetermined distance l (FIG. 4) so that a slider 44 (FIG. 2) is not likely to wear out the looper thread 28. The distance l is equal to the diameter of the needle thread 27 at the maximum. And the minimum value for the distance l may be nil; that is, the topmost surfaces 35*b* of the needle thread loops 35 may be flush with those of the looper thread 28.

Figure 15:
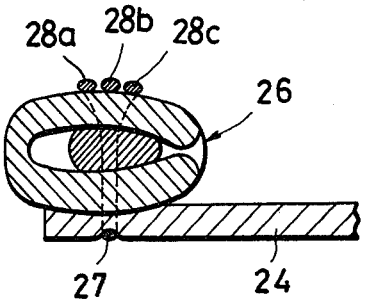
FIGS. 15 and 16 are comparative cross-sectional views illustrating looper thread under varying tension.
Figure 16:
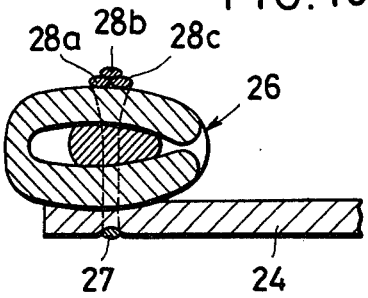

These structural features can be effected by selecting a particular degree of tension F of the looper thread 28 and a particular degree of tension f of the needle thread 27 in stitching. As is well known in the art, if the looper thread 28 is tensioned less strongly (under the tension F′) while the needle thread 27 is tensioned strongly (under the tension f′), such that looper thread portions 28*a*, 28*b*, 28*c* on the upper element leg 29 are arranged in the fashion illustrated in FIG. 15, the interlacings and interloopings 37 are retracted toward the tape 24, 25, causing the surfaces 35*b* of the needle thread loops 35 to be lowered below the surfaces 36*c* of the looper thread 28. Conversely, if the looper thread 28 is tensioned strongly (under the tension F″) while the needle thread 27 is tensioned less strongly (under the tension f″), such that the looper thread portions 28*a*, 28*b*, 28*c* are now arranged in the fashion illustrated in FIG. 16, the interlacings and interloopings 37 and hence the surfaces 35*b* of the needle thread loops 35 are raised above the surfaces 36*c* of the looper thread 28. And, such required degrees of tension F, f for the looper thread 28 and the needle thread 27 are defined by the following inequalities:

$$F'' > F > F'$$

$$f' > f > f''$$

Figure 7:
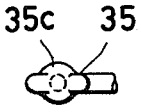
FIG. 7 is a top plan view of the needle thread loop of FIG. 6.

As shown in FIG. 7, the individual needle thread loop 35 has a widened portion 35*c*.

After stitching of the fastener elements 26 to the stringer tape 24, 25 as described above, the needle thread 27, which consists of a thermoplastic monofilament yarn, has been heat-set by applying a heated medium, for instance, during a dyeing process. As a result, the needle thread 27 has become dimensionally stable; that is, the bent configurations 35*a*,38,39 (FIGS. 3 and 4) of the needle thread 27 are maintained against further dimensional change, thereby preventing the needle thread 27 as well as the looper thread 28 from becoming loose at the cut end portions 40,41 of the slide fastener stringers 22,23, respectively.

More specifically, in case the needle thread 27 has been cut such that its cut end 42 point upwardly (FIG. 4), the needle thread 27 is not likely to become loose because the bent configuration 38 of the needle thread 27 is kept in stable. In case the needle thread 17 has been cut such that its cut end 43 point downwardly (FIG. 3), the looper thread 28 is held at its cut end portion by the extreme needle thread loop 35 of which bent configuration 35*a*,39 would not change. Accordingly, the extreme one or two of the fastener elements 26 can be prevented nicely from being separated apart from the tape 24,25, no matter where the cut end of the stringer 22,23 is located.

Figure 8:
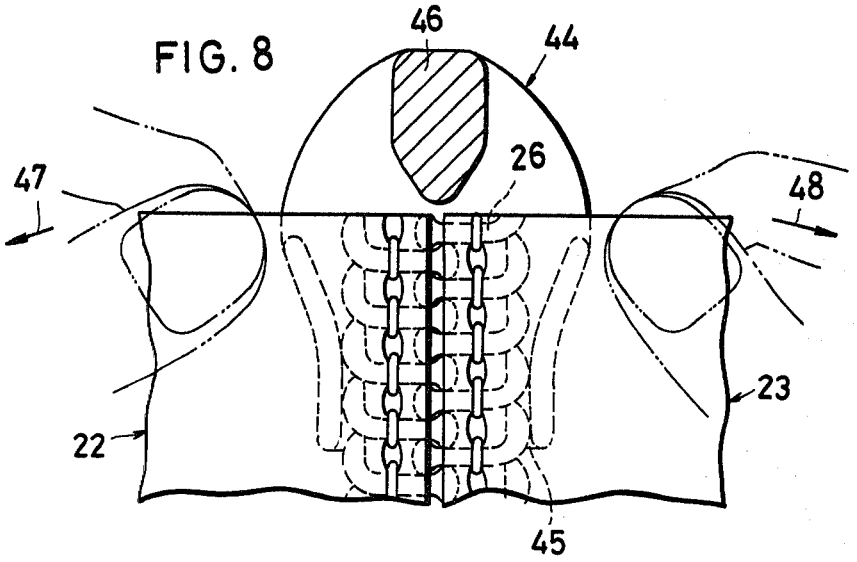
FIGS. 8 and 9 illustrate the manner in which the pair of interengaged slide fastener stringers of FIG. 1 is threaded through a slider.
Figure 9:
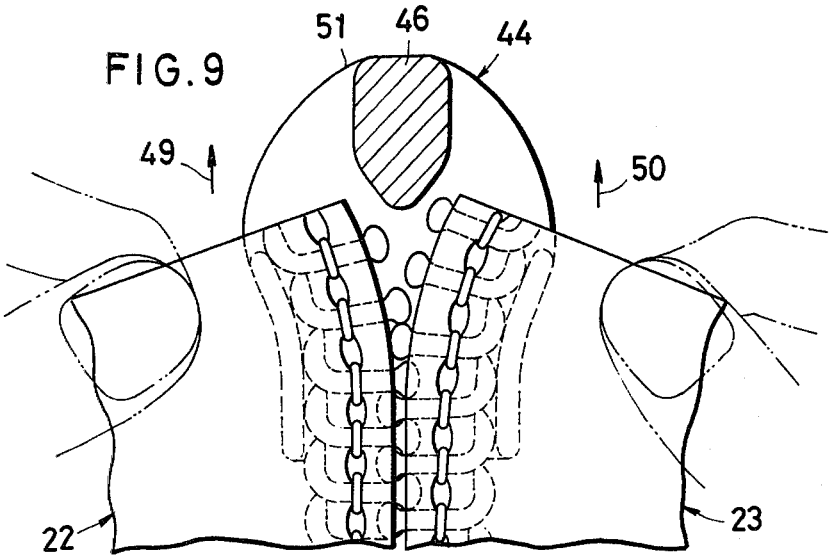

The interengaged slide fastener stringers 22,23 thus constructed can be threaded through the slider 44 (FIGS. 8 and 9) from its rear end mouth 45 with maximum ease. In such threading, the interengaged slide fastener stringer 22,23 are inserted into the slider from the rear end mouth 45 thereof until the leading end of the interengaged rows of fastener elements 26 reaches just in front of a slider neck 46, as shown in FIG. 8. At that time, the opposed stringer tapes 24,25 are gripped at their respective leading ends by the fingers. Then, the opposed stringer tapes 24,25 are pulled in the directions indicated by arrows 47,48 (FIG. 8), respectively, to disengage the mating of the opposed rows of fastener elements 16 at their leading end portions, as shown in FIG. 9. Subsequently, the opposed stringer tapes 24,25 are pulled beyond the front end 51 of the slider 44 in the directions of arrows 49,50, respectively. Thus, the mounting of the slider 44 onto the interengaged slide fastener stringers 22,23. During this threading operation, the extreme one or two of the fastener elements 26 on each tape 24,25 are kept stable in position even when relatively great pulls (47,48) act on the opposed stringer tapes 24,25.

Figure 12:
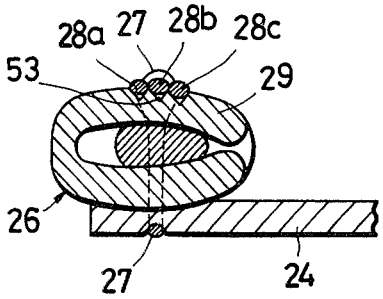
FIG. 12 is a cross-sectional view similar to FIG. 10 but showing a slide fastener stringer according to a third embodiment.
Figure 10:
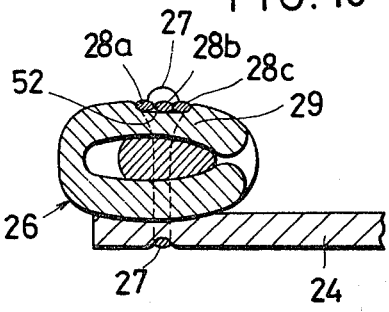
FIG. 10 is a transverse cross-sectional view of a slide fastener stringer according to a second embodiment.
Figure 11:
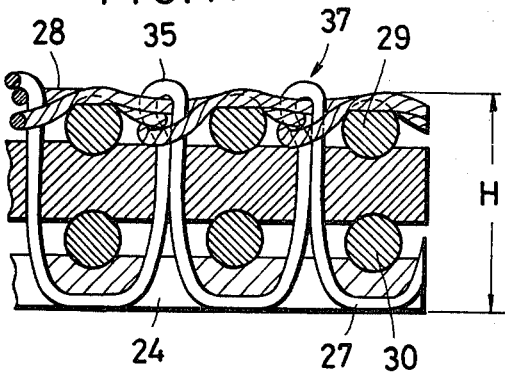
FIG. 11 is a longitudinal cross-sectional view of the slide fastener stringer of FIG. 10.

According to an embodiment of FIGS. 10 and 11, each fastener element 26 has a groove 52 extending across its upper leg 29, and the looper thread portions 28*a*,28*b*, 28*c* are received in the groove 52 and is kept in stable. According to an embodiment of FIG. 12, the upper leg 29 of each fastener element 26 has corrugations 53 for receiving the looper thread portions 28*a*,28*b*,28*c*, one in each corrugation. Given such groove 52 or corrugations 53, it is possible to minimize the thickness H (FIG. 11) of the slide fastener stringer 22,23.

Figure 13:
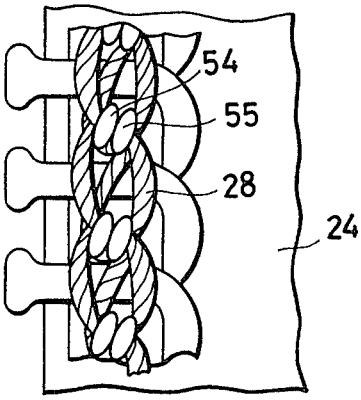
FIG. 13 is a fragmentary plan view of a slide fastener stringer according to a fourth embodiment.

According to an embodiment of FIG. 13, the lockstitching is formed with two needle threads 54,55 and one looper thread 28.

Figure 14:
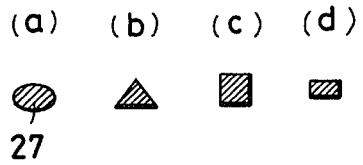
FIG. 14 illustrates various examples of cross-sectional shape of the needle thread.

To obtain an increased degree of frictional resistance, the needle thread 27 may be of a noncircular cross section, such as ellipse (a), triangle (b), square (c) or rectangle (d) (FIG. 14).

In any one of the embodiments described above, the needle thread 27 is disposed on the tape side of the slide fastener stringer 22,23, while the looper thread 28 is on the fastener-element side. With such arrangement, the slide fastener stringer can be guided in such a manner that the surface 33 of the stringer tape 24,25 on which the fastener elements 26 are to be attached faces downwardly during stitching. This requires no specially designed guide means and hence no expensive and complicated sewing machine.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A slide fastener stringer comprising:

(a) a stringer tape having a pair of opposite surfaces;

(b) a series of fastener elements disposed on one of the opposite surfaces of said stringer tape along a longitudinal edge thereof; and (c) sewing stitches securing said fastener elements to said tape and formed with at least one needle thread and a looper thread, said needle thread including a thermoplastic monofilament yarn and having loops each passing through said tape from the other surface thereof and extending through a space between adjacent two of said fastener elements, said looper thread including a non-monofilament yarn and having loops extending across and over said fastener elements, said loops of said needle thread being interlaced and interlooped with said loops of said looper thread between adjacent fastener elements;

(d) each of said loops of said needle thread having a constricted portion engaging with said loops of said looper thread, one of adjacent two loops of said looper thread extending around said constricted portion of one of said loops of said needle thread, the other loop of said looper thread being interlaced with and disposed above said one loop of said needle thread, whereby said constricted portion serves to keep said other looper thread loop from becoming loose;

(e) said needle thread, after stitching of said fastener elements to said tape, having been heat-set to become dimensionally stable.

2. A slide fastener stringer according to claim 1, said each loop of said needle thread having a top surface disposed above top surfaces of said loops of said looper thread.

3. A slide fastener stringer according to claim 1, said each loop of said needle thread having a top surface flush with top surfaces of said loops of said looper thread.

4. A slide fastener stringer according to claim 1, each of said fastener elements having at least one groove in its top surface for receiving said looper thread.

5. A slide fastener stringer according to claim 1 or 4, said needle thread having a noncircular cross section.

* * * * *